United States Patent [19]

Wieland, Jr. et al.

[11] Patent Number: 4,662,033

[45] Date of Patent: May 5, 1987

[54] TACK BUTTON ASSEMBLY

[75] Inventors: Howard N. Wieland, Jr., Holliston, Mass.; Donald D. Lake, Windham, N.H.

[73] Assignee: TRW Inc., Solon, Ohio

[21] Appl. No.: 754,323

[22] Filed: Jul. 12, 1985

[51] Int. Cl.[4] ..... A44B 1/18

[52] U.S. Cl. ..... 24/90 R; 24/90 HA; 24/90 E; 24/92; 24/108

[58] Field of Search ..... 24/90 R, 90 E, 90 A, 24/90 C, 92, 103, 113 R, 113 MP, 90.5, 108, 110

[56] References Cited

U.S. PATENT DOCUMENTS

| | | | |
|---|---|---|---|
| 451,025 | 4/1891 | Chapman | 24/90 R |
| 520,987 | 6/1894 | Radcliffe . | |
| 1,324,085 | 12/1919 | White . | |
| 1,324,086 | 12/1919 | White . | |
| 1,463,236 | 7/1923 | White . | |
| 2,267,667 | 12/1941 | Purinton | 24/90 E |
| 2,480,262 | 8/1949 | Purinton . | |
| 2,574,436 | 11/1951 | Maxim | 24/90 R |
| 2,671,255 | 3/1954 | Kember | 24/90 R |
| 3,028,646 | 4/1962 | Janes . | |
| 3,154,036 | 10/1964 | Fimmel | 24/90 HA |
| 3,577,846 | 5/1969 | Perrin . | |
| 3,623,192 | 11/1971 | Papazian | 24/108 |
| 3,705,443 | 12/1972 | Camporese et al. | 24/90 R |
| 3,715,781 | 2/1973 | Salvatori | 24/90 HA |
| 3,725,980 | 4/1973 | Burgio . | |
| 4,007,515 | 2/1977 | Angelli . | |
| 4,063,312 | 12/1977 | Braillard . | |
| 4,077,536 | 3/1978 | Brandtberg . | |
| 4,387,488 | 6/1983 | Kanzaka | 24/92 |
| 4,481,696 | 11/1984 | Kanzaka | 24/90 E |
| 4,541,148 | 9/1985 | Watanabe | 24/90 R |

FOREIGN PATENT DOCUMENTS

| | | | |
|---|---|---|---|
| 2414312 | 10/1975 | Fed. Rep. of Germany | 24/90 HA |
| 795660 | 5/1958 | United Kingdom | 24/90 HA |

*Primary Examiner*—Victor N. Sakran

*Attorney, Agent, or Firm*—Fay, Sharpe, Fagan, Minnich & McKee

[57] ABSTRACT

A tack button assembly includes a solid, deformable button body having an anchoring socket with first and second ends. The socket extends along the longitudinal axis of the body and is adapted to retainingly receive the shank of an associated tack through the socket first end. A thin cover wall which is integral with the button closes the socket first end. The construction is such that the tack penetrates a material to which the assembly is intended to be secured before breaking through the cover wall and entering the anchoring socket. Such relationships prevent the tack from creating an enlarged hole in the material and/or causing puckering of the material. A cap member is disposed in close surrounding relation to the hub portion of the button body.

3 Claims, 5 Drawing Figures

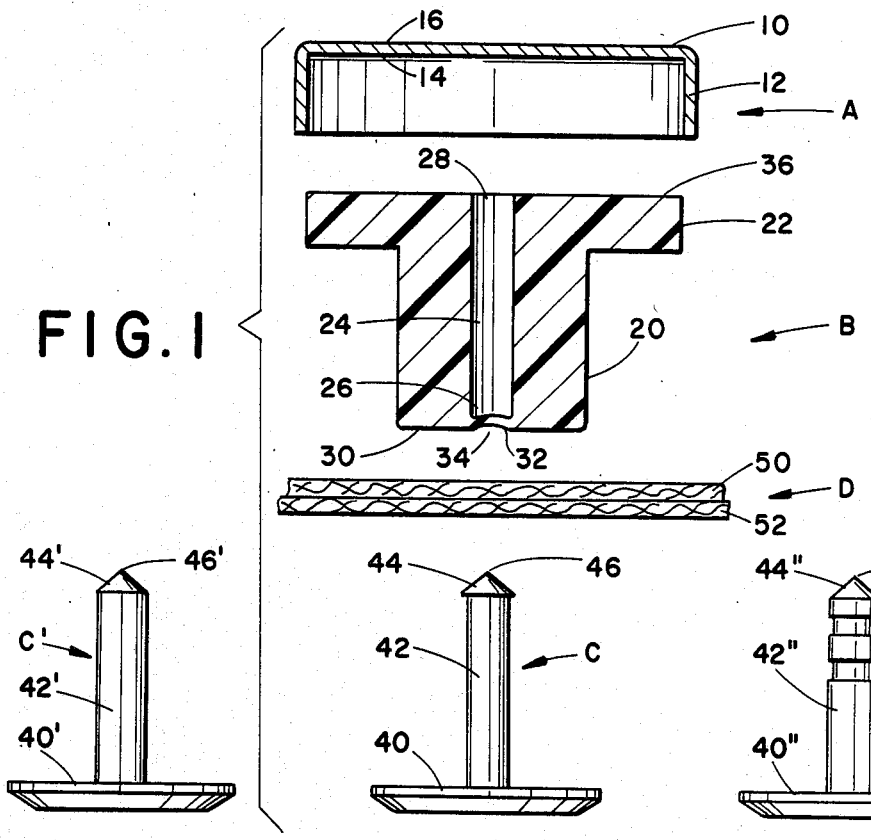
FIG. 1
FIG. 4
FIG. 5
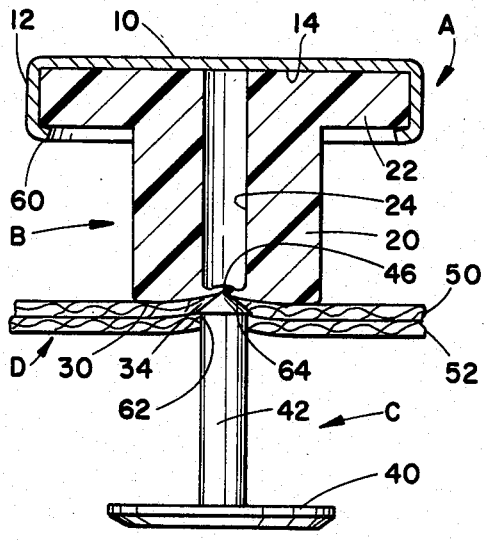
FIG. 2
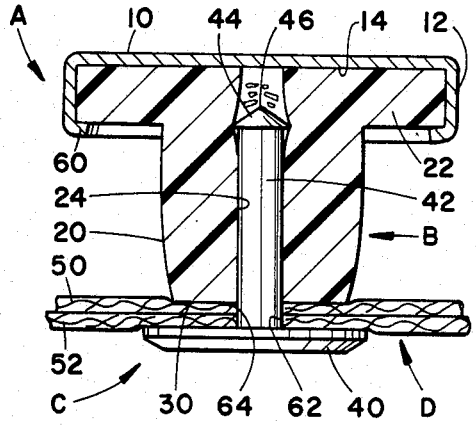
FIG. 3

TACK BUTTON ASSEMBLY

BACKGROUND OF THE INVENTION

This invention generally pertains to button attaching means. More specifically, the invention relates to a tack button assembly which is adapted to be affixed to one or more layers of a fabric or other material.

The invention is particularly applicable to a button intended to be attached to garments. However, it will be appreciated by those skilled in the art that the invention has broader applications and may also be adapted for use on fabrics or other materials employed in many other environments, such as footwear, handbags, luggage, and the like.

Tack fastened button assemblies have come into widespread use as replacements for buttons which are attached to a garment by thread. This has occurred because the conventional use of thread has a number of drawbacks, eg., it requires some amount of expertise to properly use, requires special equipment for high volume applications, is time consuming if done by hand, and has limited strength capabilities. Also, thread is subject to wear, and some buttons are lost as a result.

Button assemblies which are directed to eliminating the need for using thread include those using molded plastic buttons which are fastened to the garment by metallic tacks. One difficulty with these conventional plastic buttons is that the garment material is dragged into a tack receiving aperture provided in the button body to such a degree that an exaggerated hole is created in the fabric. Such hole, in turn, enables a pull-through condition to exist wherein the enlarged head of the tack will be pulled through the fabric hole at relatively low force levels. Also, since the fabric is dragged into the receiving aperture, it typically will pucker and cause an unacceptable or undesirable appearance.

Accordingly, it has been considerred desirable to develop a new and improved tack button assembly which would overcome the foregoing difficulties and others while providing better and more advantageous overall results.

BRIEF SUMMARY OF THE INVENTION

In accordance with the present invention, a new and improved tack button assembly is advantageously provided.

More particularly in accordance with the invention, the tack button assembly includes a solid button body having an anchoring socket with spaced apart first and second ends. The socket extends axially in the body and is adapted to receive the shank of an associated tack through the socket first end. A thin cover section or wall initially closes the socket first end and is penetrated by the tack shank at the time the button assembly is mounted to an associated material.

In accordance with another aspect of the invention, the closed socket first end supports the fabric or other material to which the assembly is being secured, and thereby allows the tack to make initial penetration of the fabric rather than pulling the fabric into the button socket. A pulling condition is undesirable because it creates fabric puckering and further leads to the piercing of an enlarged hole in the fabric. Further, when the tack penetration reaches a certain distance, the closed socket first end will fracture, thereby creating a generally circular opening having a sharp edge. This sharp edge assists in the cutting of a minimum hole in the fabric, and prevents the fabric from further entry into the socket.

According to still another aspect of the invention, the associated tack has an enlarged head and a generally cylindrical shank which may take several conformations. In the preferred embodiment, the shank is cylindrical and has an enlarged, tapered point end. The base diameter of the tapered point is greater than the cylindrical shank diameter, and is slightly greater than the inside diameter of the button anchoring socket.

According to alternative constructions of the tack, the shank has a generally cylindrical cross-section with a tapered point end, and the shank may include a series of axially spaced diametral reductions. The diametral reductions provide areas into which displaced material from the button may flow, thus creating anchoring points.

In accordance with yet a further aspect of the invention, the button assembly is constructed from a deformable plastic material, and a cap is closely received around the body hub to maintain the tack button components in assembly.

The principal advantage of the present invention is the provision of a new tack button assembly in which a button may be firmly fastened to some material by a tack while preventing material puckering and the creation of a pull-through condition.

A further advantage of the invention resides in a tack button assembly in which the shank of a tack is received by and firmly gripped in the button without the necessity for employing additional retaining means.

Still other advantages and benefits of the invention will become apparent to those skilled in the art upon a reading and understanding of the following detailed specification.

BRIEF DESCRIPTION OF THE DRAWINGS

The invention may take physical form in certain parts and arrangements of parts, preferred and alternative embodiments of which will be described in detail in this specification and illustrated in the accompanying drawings which form a part hereof, and wherein:

FIG. 1 is an exploded cross-sectional view of a preferred embodiment of the subject new tack button assembly;

FIG. 2 shows the tack button assembly of FIG. 1 in a partially installed condition with the tack having penetrated through two fabric layers;

FIG. 3 is a cross-sectional view showing the tack button assembly of FIG. 1 in a fully assembled and installed condition;

FIG. 4 is a cross-sectional view of an alternative tack embodiment; and

FIG. 5 is a cross-sectional view of another alternative tack embodiment.

DETAILED DESCRIPTION OF THE PREFERRED AND ALTERNATIVE EMBODIMENTS

Referring now to the drawings, wherein the showings are for purposes of illustrating preferred and alternative embodiments of the invention only and not for purposes of limiting same, FIG. 1 shows an exploded view of the subject new tack button assembly. While the tack button assembly is primarily designed for garment fabrics, it will be appreciated that the overall inventive concept could be adapted to use with other materials as well.

More particularly, the tack button assembly of the present invention includes a cover member A, a button B, a tack member C, and one or more fabric or other material layers D. The cover A is comprised of a base 10 having a peripheral skirt 12 depending therefrom. The cover has an inner face 14 adapted for mating engagement with the button B, and an outer face 16 which may be of a particular color, have an intaglio motif, or some other decoration as desired.

The button member B is comprised of a head portion 20 having a hub 22 disposed at one end thereof. Head 20 and hub 22 are preferably cylindrical with the hub having a larger diameter than the head. An anchoring socket or aperture 24 extends coaxially through both head 20 and hub 22 from a first end 26 to a second end 28. Aperture first end 26 terminates adjacent a forward end face 30 of head 20 at an integrally formed cover or wall 32. End face 30 is generally flat, but is slightly depressed or recessed at area 34 which generally corresponds with wall 32. Wall 32 thus closes anchoring socket 24 somewhat below the plane of hub forward end face 30. Rear face 36 at hub 22 also is generally flat and is adapted to be positioned against inner face 14 of the cover A. Button body B preferably is comprised of a plastic material, such as nylon or the like, and may be given a particular color as desired.

In the preferred embodiment, the inner and outer faces of wall 32 are generally spherical. That is, the outer face which extends inwardly from the plane of end face 30 for defining depressed area 34 comprises a portion of a sphere facing outwardly of the end face. The face of the wall 32 which faces into anchoring socket 24 also is generally spherical in nature. However, it is preferred that the spherical radius of the outer face be greater than the spherical radius of the inner face. Indeed, it is desired that the outer face spherical radius be greater than the diameter of the anchoring socket, and that the outer spherical radius extend into a region of end face 30 surrounding the socket.

The tack C is comprised of a head portion 40 having a generally cylindrical shank portion 42 extending therefrom. The free end of the shank has a short, tapered front portion 44 which terminates in a point 46 adapted to pierce the fabric material D and wall 32 in a manner to be described. The base diameter of the tapered point is greater than the diameter of the shank, and is slightly greater than the inside diameter of button anchoring socket 24.

An alternative embodiment is illustrated in FIG. 4 where like components are identified by like numerals with a primed (') suffix. As shown, the base diameter of the tapered portion 44' is equal to the diameter of shank 42'. The shank diameter in this alternative embodiment is slightly greater than the inside diameter of the socket for retention purposes as will be explained hereinbelow.

Another alternative embodiment is shown in FIG. 5 where like components are identified by like numerals with a double primed (") suffix and new components are identified by new numerals. This construction uses a series of axially spaced diametral reductions or circumferential grooves 48 along generally cylindrical tack shank 42". Any displaced button material may flow into the reduced areas thus providing anchoring points. Here, tapered front portion 44" of the shank is dimensioned in the same manner as the FIG. 4 embodiment, although it could also be dimensioned in a manner similar to the embodiment of FIG. 1.

Numerous tack shapes may be used with success in addition to the previously described embodiments. Design modifications which alter the shape of the shank but retain the piercing function and retaining relationship of the tack and button anchoring socket may also be satisfactorily used.

In the preferred construction, the tack would typically be constructed from one of two materials on the basis of intended application. For lighter weight, lower load carrying applications, the tack could be made of a die-cast material. For heavier applications and higher load capacities, the tack could be made of carbon steel drawn into the preferred tack form. Alternatively, the tack may be cold-formed from material such as aluminum.

The fabric D may include first and second fabric layers or plies 50, 52 comprised of any conventional garment material, such as denim. Of course, it will be appreciated that any number of fabric plies could be involved as a function of the particular application for the button assembly. Moreover, the button is also advantageously suited for use with materials other than fabrics.

With reference now to FIG. 2, the cover A is shown as having been secured to the button B by deforming a free end 60 of the peripheral skirt 12 inwardly over the bottom or inner end of button hub 22. For this purpose, the cover A preferably is made from a bendable metal. However, it should be recognized that the cover could also comprise a suitable plastic layer capable of, for example, being formed around the button hub 22. The cover may have a design or seal stamped therein as may be desired for aesthetic purposes.

It will be seen that when the tack point 46 penetrates the two layers of fabric 50, 52, it creates coaxial apertures 62, 64 therein as by a piercing type action. While the tack C is penetrating the fabric D, wall 32 prevents the fabric from entering anchoring socket 24 in the button body. Closure of the socket 24 overcomes a basic problem experienced with conventional buttons, especially buttons of the plastic type, in which an open anchoring socket is subject to drag-through of the fabric material. Such drag-through is highly undesirable because it creates an exaggerated hole in the fabric which allows the tack head to be pulled through the fabric hole at relatively low force levels. Also, such a drag-through condition typically will give an unacceptable puckered appearance to the fabric at the area around the aperture.

With the present invention, however, integral wall 32 supports the fabric until tack point 46 is pierced therethrough. Only then does the tack point proceed to break through the wall for entry into socket 24. Because it is the tack point which first penetrates wall 32, the fabric is effectively excluded from being pulled into the anchoring socket. This, in turn, prevents an enlarged hole from being created in the fabric and prevents the tendency of the fabric to pucker. Depression area 34 is beneficial for allowing the tack point to penetrate both layers of fabric before it encounters wall 32.

The fracture of the closed socket first end creates a generally circular opening having a sharp edge. The tapered shape of the tack point and the radially varying thickness of wall 32 facilitate the formation of the circular opening with a sharp edge as will be explained hereinbelow. This sharp edge assists in the cutting of a minimum hole in the fabric in addition to preventing further fabric entry into the socket.

The thickness of wall 32 is, by way of example only, generally 0.015 inches. The wall thickness is gradually reduced from a central maximum thickness to a slightly thinner outer portion as wall 32 radially approaches the socket wall 24. This change in thickness allows wall 32 to fracture in a generally circular path where the path is generally adjacent the wall of socket 24. This enables the wall to have adequate resistance to penetration as the point is penetrating the fabric D, but does not provide too much resistance to penetration by the tack itself. Depression area 34 provided at front face 30 is generally around 0.010 inches in depth. This distance adequately allows the tack point to pierce the fabric before it encounters wall 32.

With reference now to FIG. 3, the tack C is there shown as having fully entered anchoring socket 24. It will be seen that the button body has a somewhat outwardly bowed conformation. This is due to the fact that the tack shank is designed to have a diameter larger than the diameter of the socket. Such relationship facilitates the application of a greater retaining force against the shank by the button body to ensure that the button assembly will remain firmly connected to the fabric D. Also, the slightly enlarged base diameter of shank front portion 44 deforms an area of the side wall of socket 24 to enhance the connected relationship between the tack and button. The button assembly is thereby able to better resist mechanical separation forces which are encountered by the garment during normal use as well as during any misuse.

Use of a tack shank which has a diameter greater than the socket diameter also aids in preventing the tack from pulling fabric into the socket. Once fractured, wall 32 enters the socket and remains trapped therein. It is evident from FIG. 3 that the length of tack shank 42 is less than the length of socket 24. This assures that tack point 46 does not engage cover member A at socket second end 26, even when the tack is fully inserted into the socket.

The button assembly of the present invention may be securely attached to the fabric of an associated garment or other article by a conventional mechanical apparatus or by hand in a simple and rapid operation. The subject invention provides a tack button assembly which overcomes the basic problems of prior button assemblies, especially those utilizing plastic buttons, in which a hole is punched in the fabric to accommodate securing of a button thereto by a tack member. If desired for particular applications, the outer peripheral conformation of the button body head and hub may be modified as appropriate, eg., hexagonal, octagonal, and the like. Also, if desired for material retention purposes, head portion forward end face 30 may include a plurality of small axial protrusions extending outwardly therefrom. Such protrusions may be integrally formed with the button and located at spaced intervals on the head portion end face in surrounding relation to the anchoring socket 24. The protrusions will be pulled into the surface of a fabric or other material when the button assembly is installed thereon.

The invention has been described with reference to preferred and alternative embodiments. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A tack button assembly comprising:

a deformable button body including a head portion, an enlarged hub portion positioned at one end of said head portion, an elongated anchoring socket opening defined by an interior wall extending axially of said button body and having an entrance end in said head portion, and a cover wall closing said anchoring socket opening closely adjacent said entrance end located between and joined to said interior wall, said cover wall having a relatively thicker central portion joined to said interior wall by a relatively thin peripheral outer edge portion; and, a tack including an enlarged head having an elongated shank extending outwardly therefrom to a pointed terminal end for selectively penetrating said cover wall with at least the portion of said shank adjacent said terminal end having a larger cross-sectional dimension than said anchoring socket, said tack shank adapted to penetrate a material to which said button assembly is to be affixed and cause fracture of said cover wall about its outer peripheral edge portion to create a sharp edge about said socket opening to prevent pull-in of material as said shank enters into an axially inserted relationship with said anchoring socket to thereby avoid puckering of said material about said button, said socket adapted to retainingly embrace and retain said portion of said tack shank.

2. The tack button assembly of claim 1 further including a cap disposed in close surrounding relation to said hub portion.

3. The tack button assembly of claim 1 wherein said tack shank includes at least one diametral reduction therealong.

* * * * *